343-700 MS AU 254 EX
3/15/83 OR 4,376,938

United States Patent [19]
Toth et al.

[11] 4,376,938
[45] Mar. 15, 1983

[54] WIRE GRID MICROSTRIP ANTENNA

[75] Inventors: John F. Toth, Billerica; Richard J. Conti, Belmont; Nunzio M. Cavallaro, Lawrence; Thomas B. Dowling, Lowell, all of Mass.

[73] Assignee: Raytheon Company, Lexington, Mass.

[21] Appl. No.: 141,022

[22] Filed: Apr. 17, 1980

[51] Int. Cl.[3] ..... H01Q 1/38
[52] U.S. Cl. ..... 343/700 MS
[58] Field of Search ..... 343/700 MS, 897, 848

[56] References Cited

U.S. PATENT DOCUMENTS 3,290,688 12/1966 Kraus ..... 343/731

OTHER PUBLICATIONS

J. Kraus, *A Backward Angle-Fire Array Antenna,* IEEE Transactions on Antennas and Propagation, Jan. 1964.

*Primary Examiner*—Theodore M. Blum
*Attorney, Agent, or Firm*—Philip J. McFarland; Joseph D. Pannone

[57] ABSTRACT

An antenna, adapted to be used as a monopulse antenna in a guided missile, is shown to comprise four separate microstrip circuits in different quadrants of a circular microstrip arrangement, each one of such microstrip circuits being made up of an array of contiguous rectangular meshes with the widths of the shorter sides of such meshes being varied to provide an amplitude taper.

4 Claims, 3 Drawing Figures

FIG. 2A
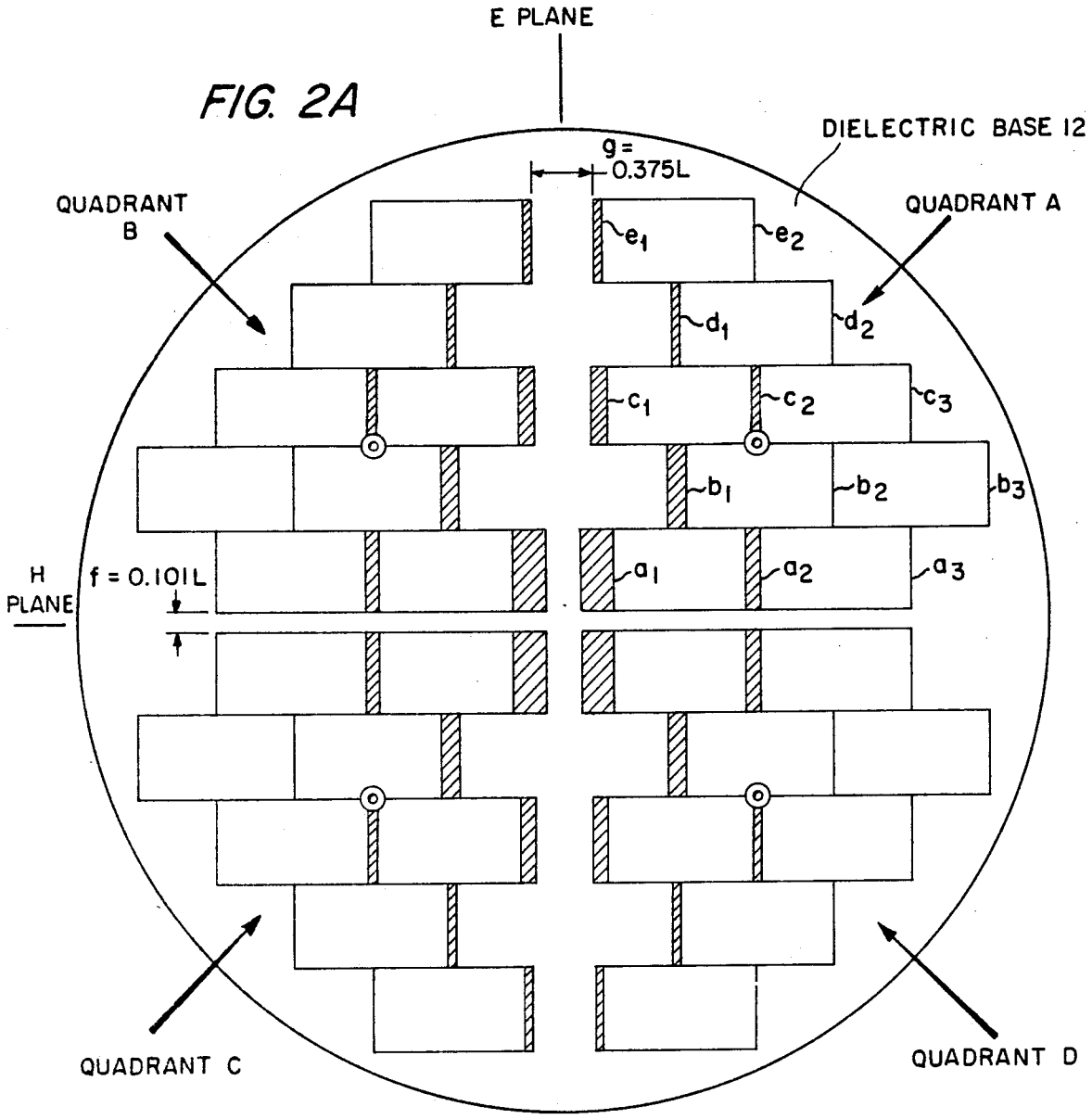
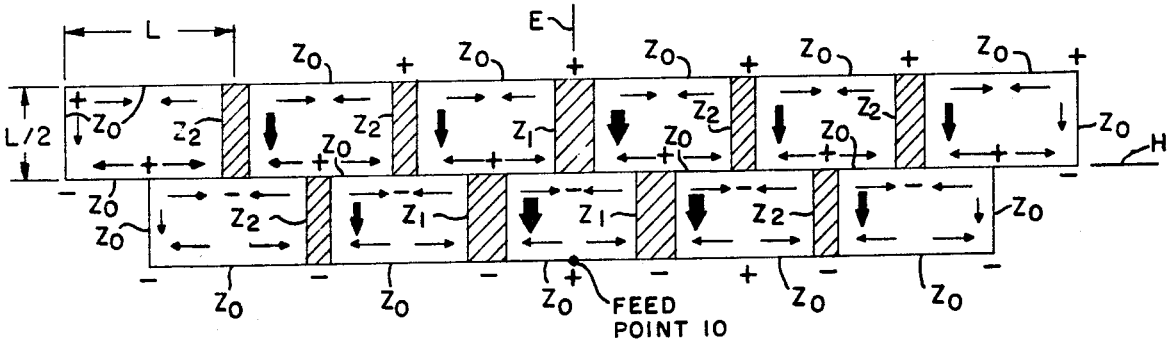
FIG. 1

WIRE GRID MICROSTRIP ANTENNA

BACKGROUND OF THE INVENTION

This invention pertains generally to antennas for radio frequency energy and particularly to directional antennas wherein the active elements are interconnected electrically to form a grid of radiating and conductive members.

It has been proposed, as outlined in an article in the IEEE "Transactions on Antennas and Propagation," January 1964, by Kraus, that the conductor of a microstrip transmission line be disposed in a grid-like pattern to form an array antenna for radio frequency energy. In the just-mentioned article, the contemplated grid-like pattern appears to form a planar array of similar rectangular meshes with each mesh having longer sides equal in length to one wavelength and shorter sides equal in length to one-half wavelength. Further, the longer sides of adjacent meshes are contiguous to form columns of rectangular meshes with the shorter sides of the individual rectangular meshes in alternate ones of the columns being staggered to be connected at the center of the longer sides of the contiguous rectangular meshes in the adjacent columns. Various specific arrangements where grid-like structures are positioned over a metallic ground plane with air as the dielectric are shown by Kraus in U.S. Pat. No. 3,290,688.

Although printed circuit array antennas built following the principles set out by Kraus and others have proven advantageous, particularly in many of those applications in which physical size, ease of fabrication and ability to operate at elevated temperatures are controlling characteristics, there are some applications in which deficiencies of such antennas have heretofore militated against their use. Specifically, an array antenna being discussed often may not be used in a guided missile wherein space is at a premium and ambient conditions are adverse.

The key deficiencies suffered by known array antennas of the type being discussed are: (a) an extremely narrow bandwidth; (b) a susceptibility to cross-polarization; and (c) an inability to control amplitude taper, thus resulting in excessively high sidelobes. These deficiencies, either alone or in combination, so overbalance the desirable characteristics of any known printed circuit antenna that only conventional slotted or stripline arrays are presently used in guided missiles, especially when monopulse characteristics are desired.

SUMMARY OF THE INVENTION

With the foregoing background of this invention in mind, it is a primary object of this invention to provide a microstrip antenna which is adapted to use as an antenna in a guided missile.

Another object of this invention is to provide a microstrip antenna having a relatively wide bandwidth as compared to known microstrip antennas.

Another object of this invention is to provide a microstrip antenna which is relatively immune to cross-polarization effects as compared to known microstrip antennas.

Still another object of this invention is to provide a microstrip antenna which generates lower sidelobes than known microstrip antennas.

A still further object of this invention is to provide a microstrip antenna which is adapted to use as a monopulse antenna.

The foregoing and other objects of this invention are met generally by a contemplated wire grid microstrip antenna wherein the pattern of individual rectangular meshes making up the radiating elements is formed, in accordance with the desired shape of antenna aperture, to: (a) optimize bandwidth; (b) reduce crosspolarization effects; (c) reduce the amplitude of sidelobes; and (d) permit monopulse operation.

BRIEF DESCRIPTION OF THE DRAWINGS

For a more complete understanding of this invention reference is now made to the following description of the accompanying drawings, wherein:

FIG. 1 is a sketch showing an exemplary linear array according to the invention to illustrate in the simplest and clearest manner the way in which the amplitude of sidelobes may be reduced;

FIG. 2A is a plan view of a monopulse antenna fabricated according to this invention.

DESCRIPTION OF THE PREFERRED EMBODIMENTS

Figure 2B:
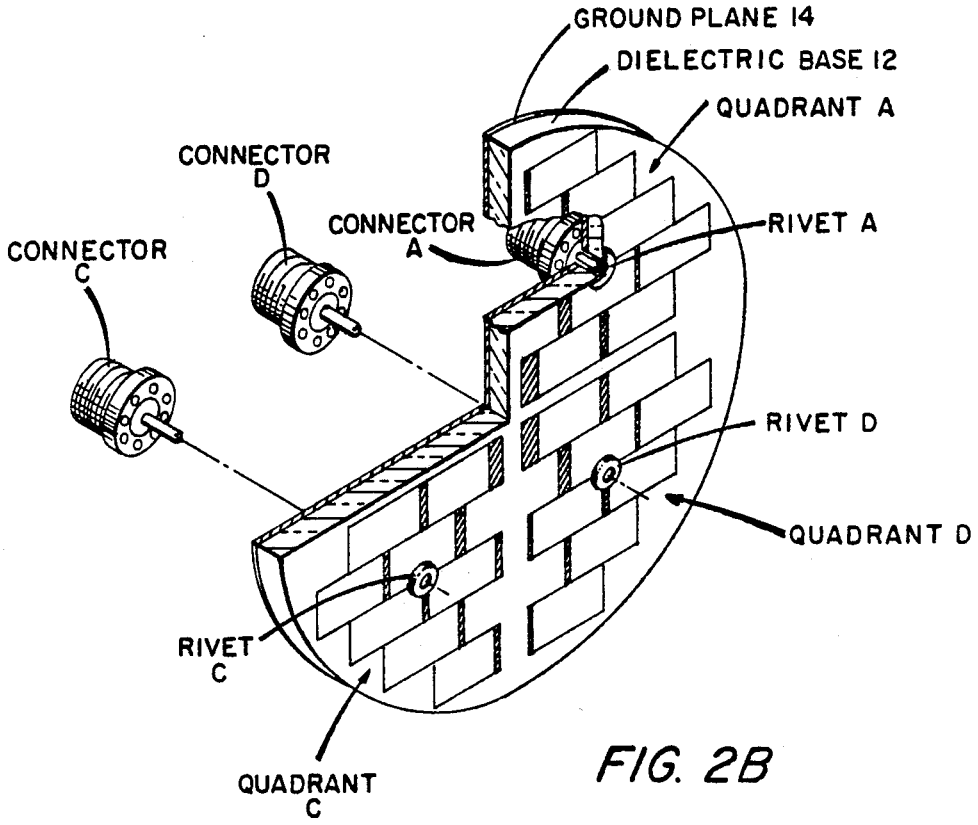
FIG. 2B is an isometric view, partially cut away for clarity of illustration, of the antenna shown in the plan view of FIG. 2A.

Referring now to FIG. 1, it may be seen that a linear array antenna according to this invention here is made up of contiguous rectangular meshes (not numbered) disposed in two rows offset from one another, as shown. The longer sides of each one of the rectangular meshes (measured between centers of the shorter sides) are dimensioned to be equal to one wavelength in the effective air/dielectric medium at the center frequency of the band of radio frequencies for which the linear array antenna is to be used. The shorter sides of each one of the rectangular meshes are dimensioned to be equal to one-half wavelength in the effective air/dielectric medium at such center frequency. A feed point 10 is provided, as shown. The widths of the shorter sides of the rectangular meshes are systematically changed, such widths being greater in the central portion of the illustrated array, tapering to the edges (where such widths are the same as the widths of the longer sides of the rectangular meshes). It will be appreciated that the characteristic impedance of each one of the sides of the rectangular meshes is inversely related to its width. That is to say, $Z_1 < Z_2 < Z_0$ where Z represents a characteristic transmission line impedance and the subscript indicates the indicated side of each rectangular mesh. It follows then, as indicated by the width of each arrow in FIG. 1, that the intensity of the instantaneous current in the shorter sides of the rectangular meshes correspondingly is tapered from the central portion to the edges. A moment's thought will now make it clear that, with a sufficiently large number of rectangular meshes, the intensity of the instantaneous current in the shorter sides of the rectangular meshes may be controlled to approximate any given type of amplitude weighting from one end of the array to the other. To put it another way, the magnitude of the electric field (the E-field) may be weighted in any desired manner, say by Taylor weighting.

Referring now to FIGS. 1 and 2A, it will be observed that, because of the dimensions of the individual rectangular meshes, the instantaneous currents through each one of the shorter sides of each rectangular mesh are in phase with one another and produce radiation in the E-plane. It will also be observed that the instantaneous currents through the longer sides of each one of the rectangular meshes produce radiation in the H-plane. The foregoing means that: (a) there is little energy radiated from the longer sides of the rectangular meshes with polarization parallel to the E-plane; and (b) that amplitude tapering on the shorter sides may reduce sidelobes in the E-plane polarization. As a matter of fact, a linear array as illustrated in FIG. 1 has been constructed and tested (with $Z_0=102$ ohms, $Z_1=60$ ohms and $Z_2=79$ ohms) to demonstrate that the peak level of the first sidelines in the E-plane may be reduced by some five decibels more than the peak level of corresponding sidelobes when amplitude tapering is not incorporated in an otherwise similar linear array.

It will be observed in FIG. 1 that the instantaneous current distributions in the longer sides of each rectangular mesh are the same as the current distributions in two parallel pairs of antiphase radiating elements (each one of such elements being one-half wavelength in length) spaced one-half wavelength apart between centers. Further, it will be observed that the instantaneous current distributions in the shorter sides of each rectangular mesh are the same as the current distributions in a pair of parallel radiating elements (each being one-half wavelength in length) which are spaced one wavelength apart. The polarization of any energy radiated from each one of the longer and shorter sides is linear; however, the direction of polarization of any energy from a longer side is orthogonal to the direction of polarization from a shorter side. In other words, energy radiated from a longer side may be considered to be "cross-polarized" with respect to energy radiated from a shorter side and energy from the two shorter sides may be considered to be "co-polarized". It may be shown, using conventional array analytic methods, that: (a) any energy radiated from the longer sides of a single rectangular mesh forms four symmetrically disposed lobes with nulls along the E and H principal planes; and (b), energy radiated from the shorter sides form a single lobe centered on the intersection of the E-plane and the H-plane. As the number of rectangular meshes is increased, the spacing between adjacent ones of such meshes is such that: (a) destructive interference is experienced by energy radiated from longer sides of the different rectangular meshes; and (b) constructive interference is experienced by energy radiated from shorter sides of different rectangular meshes. The result then is that, in theory at least and with proper placement of the rectangular meshes, the "cross-polarized" portion of the radiated energy may be suppressed to any desired degree by adding rectangular meshes.

It will be appreciated, however, that the bandwidth of any array of rectangular meshes (wherein the dimensions of each individual mesh are related to the wavelength of the energy to be radiated) is limited. The restriction on bandwidth is primarily due to the fact that the instantaneous current distributions in the shorter sides of all rectangular grids in an array must here appear to remain substantially "in phase" with one another. That is, the electrical length of the sides of the rectangular meshes and the relative positions of such meshes must be such that the electric fields associated with each one of the shorter sides of all rectangular meshes vary in synchronism with one another.

Referring now to FIGS. 2A and 2B, an antenna particularly adapted for use in a guided missile is shown. Thus, the illustrated antenna is designed for use at X-band, the aperture is circular with a diameter of about five wavelengths and monopulse operation is possible. The performance specifications of the illustrated antenna require that: (a) sidelobes in the sum pattern be down at least 18 decibels from the peak of the mainlobe; (b) sidelobes in the difference pattern be down at least 12 decibels; (c) the level of cross-polarized energy be down more than 20 decibels from the level of co-polarized energy; and (d) the bandwidth of the antenna be in the order of 3 to 6 percent.

With the foregoing in mind, a grid-like pattern, made up of four similar metallic circuits (labeled QUADRANT A, QUADRANT B, QUADRANT C and QUADRANT D) are disposed on a dielectric base 12 (here made from "DUROID 5880" manufactured by the Rogers Corporation, Phoenix, Ariz.) by conventional printed circuit techniques. The second side of the dielectric base 12 is covered by a metallic ground plane 14.

Because the metallic circuits in the quadrants are mirror images of each other, only the metallic circuit in QUADRANT A will be described. Thus, realizing that the number of complete rectangular meshes in QUADRANT A must be maximized and that the rectangular meshes must be connected to maintain instantaneous current distributions in the sides of each one of such meshes which are similar to the instantaneous current distributions shown in FIG. 1, the individual meshes are disposed as shown. The width of each one of the longer sides is constant (here 0.050 inches). The width of each one of the shorter sides here is (in inches):

$$a_1=0.209;\ a_2=0.089;\ b_1=0.111;\ b_2=0.046;$$

$$c_1=0.076;\ c_2=0.058;\ d_1=0.041;\ e_1=0.024;\ \text{and}$$

$$a_3=0.029;\ b_3=0.010;\ c_3=0.014;\ d_2=0.016;\ e_2=0.013.$$

It will be appreciated that: (a) a single continuous array with a centrally located feed would provide the optimum arrangement for the generation of a sum beam; and (b) four separate arrays must be provided to generate the requisite monopulse difference signals to allow calculation of angle error signals in pitch and yaw. Here, therefore, the quadrants (QUADRANTS A, B, C and D) are separated as required for monopulse operation, with separation adjusted for optimum performance. Thus, distance f here is 0.0101 L and distance g is 0.375 L. With the widths of the sides of the rectangular meshes in each quadrant dimensioned as just listed and the quadrants spaced from each other as indicated above, a circular Taylor amplitude taper is closely approximated for the sum beam, i.e. the beam resulting when all four quadrants are simultaneously excited.

The feed for each quadrant is connected to as close to the center of the quadrant as possible to maximize bandwidth. Thus a hole (not numbered) is formed through the metallic ground plane 14, the dielectric base 12 and the overlying portion of the metallic circuits (QUADRANTS A, B, C and D) to allow a center conductor (not numbered) extending from a coaxial connector (A, B, C or D) to be inserted from the rear. A hollow rivet (rivet A, B, C, D) is pressed over the free end of the center conductor, with the flange of such rivet bridging the gap in the metallic circuitry. The rivets may then be affixed in any convenient manner (as by soldering) to complete the contemplated antenna. Coaxial cables (not shown) may then be supplied to connect the antenna with appropriate circuitry.

Having described this invention, it will now be apparent to one of skill in the art that the number and disposition of the various rectangular meshes may be changed without affecting this invention. Further, the widths of the shorter sides of the rectangular meshes could be changed to achieve an amplitude taper which differs from the one discussed or the material from which the dielectric base is fabricated could be changed. It is felt, therefore, that this invention should not be restricted to its disclosed embodiment, but rather should be limited only by the spirit and scope of the appended claims.

I claim:

1. A planar array antenna for radio frequency energy wherein the strip conductor of a microstrip line is disposed on a surface of a dielectric base to form a mesh of rectangles having openings equal to $L \times L/2$, where L is equal to the wavelength of the radio frequency energy, the centers of shorter sides of the sides defining adjacent openings of such mesh defining a triangular grid, such array comprising:

(a) means for amplitude tapering the radio frequency energy radiated from the shorter sides of the sides defining the openings in the mesh of rectangles; and (b) means for feeding radio frequency energy to the mesh of rectangles.

2. A planar array antenna as in claim 1 wherein the widths of the shorter sides partially defining each opening in the rectangular mesh are progressively decreased from the center of such mesh to effect a predetermined amplitude tapering.

3. A planar array antenna wherein at least a first and a second rectangular mesh are formed by strip conductors of a microstrip line to define the aperture of a monopulse antenna, the opening in such mesh being equal to $L \times L/2$, where L is the wavelength of the radio frequency energy, such antenna being characterized by having the widths of the shorter sides of the sides defining each opening being progressively tapered from the center of the aperture outwardly.

4. A planar array antenna as in claim 3 characterized further in that means are connected to the midpoint of each rectangular mesh to feed separately radio frequency energy to each such mesh.

* * * * *